US007371123B2

(12) United States Patent
Loi et al.

(10) Patent No.: US 7,371,123 B2
(45) Date of Patent: May 13, 2008

(54) ELECTRICAL CONNECTOR

(75) Inventors: Shu-Man Luman Loi, Taiwai (HK); Vincent Lam, Sheung Shui (HK)

(73) Assignee: Radio Shack Corporation, Fort Worth, TX (US)

( * ) Notice: Subject to any disclaimer, the term of this patent is extended or adjusted under 35 U.S.C. 154(b) by 0 days.

(21) Appl. No.: 11/133,998

(22) Filed: May 20, 2005

(65) Prior Publication Data

US 2006/0264115 A1 Nov. 23, 2006

(51) Int. Cl.
*H01R 24/04* (2006.01)

(52) U.S. Cl. ..... 439/668; 439/63; 439/607

(58) Field of Classification Search ..... 439/63, 439/668, 607
See application file for complete search history.

(56) References Cited

U.S. PATENT DOCUMENTS 4,340,269 A * 7/1982 McGeary ..... 439/583
4,440,464 A * 4/1984 Spinner ..... 439/218
4,464,001 A * 8/1984 Collins ..... 439/318
4,538,023 A 8/1985 Brisson
4,777,324 A 10/1988 Lee
4,932,897 A 6/1990 Lee
5,015,195 A * 5/1991 Piriz ..... 439/318
D323,643 S 2/1992 Lee
D325,023 S 3/1992 Lee
D328,249 S 7/1992 Lee
D329,223 S 9/1992 Lee
5,178,504 A * 1/1993 Falchi ..... 411/553
D366,862 S 2/1996 Lee
D366,863 S 2/1996 Lee
D367,036 S 2/1996 Lee
5,529,518 A 6/1996 Wood
D371,762 S 7/1996 Lee
D374,862 S 10/1996 Lee
D376,580 S 12/1996 Lee
5,662,488 A * 9/1997 Alden ..... 439/314
5,713,765 A * 2/1998 Nugent ..... 439/700
D415,101 S 10/1999 Martin
6,561,841 B2 * 5/2003 Norwood et al. ..... 439/489
6,811,422 B1 * 11/2004 Muller ..... 439/314
2004/0032746 A1 * 2/2004 Kakidaira et al. ..... 362/548

* cited by examiner

*Primary Examiner*—James Harvey

(57) ABSTRACT

An electrical connector for use, for example, at the end of an audio visual (A/V) system cable. The connector includes a body from which extends a sleeve for engaging a corresponding feature of another electrical connector. The sleeve of the electrical connector of the present invention forms a slot having a first portion and a second portion that intersect with each other, the first slot portion having an orientation that varies from the orientation of the second slot portion. In one embodiment, the connector includes a cylindrical sleeve, and the slot first portion extends from the distal end of the sleeve parallel to the connector's central axis and intersects the slot second portion at a right angle, meaning that in combination the first slot-portion and the second slot portion define a clip that extends along the periphery of the sleeve.

8 Claims, 18 Drawing Sheets

ELECTRICAL CONNECTOR

FIELD OF THE INVENTION

The present invention is directed generally to the field of electrical connectors, and is directed more specifically to a design for reliable connectors that are used in applications requiring convenience in connecting and disconnecting without sacrificing reliability in performance, and also exhibiting a tolerance for mating with connectors that may deviate from a standard size. Connectors according to the present invention may, for example, be used for the electrical cables connecting the various audio and video components of a home entertainment system.

BACKGROUND

Electrical connectors are used in a wide variety of applications including, frequently, at the terminus of the electrical cables that are used to connect separate pieces of equipment. Applications using such cables may range from heavy-duty industrial applications, to telecommunications, to home electronics. As one example, many consumer-oriented electronics systems are component systems rather than integrated systems. In other words, instead of having all portions of a particular electrical system in one physical unit, where the internal components would be connected by internal wiring, it is very common to have each of the components manufactured as a separate individual physical device that can be purchased separately and then connected together by the consumer.

For consumer-oriented applications especially, the connections should be easy to make and to disconnect, although they also have to be reliable. Since the consumer may buy various system components from different manufacturers, some tolerance in the design of the interconnecting elements is also desirable. When these components are connected to one another, cables may be used to make the connection. The cables may be supplied along with each individual system component, or they may be separately purchased on an as-needed basis. Separately-purchased cables are often available in higher-quality versions than those provided with the units, and are frequently produced by a manufacturer other than the one supplying the basic system components. Small deviations in size are possible.

In this context, electrical cables include one or more wires or other conductors enclosed in some kind of dielectric or insulating material. A typical cable for use in home entertainment systems includes an insulated central or axial wire surrounded by a mesh conductor, with this assembly surrounded by another, exterior insulating material. The cables are typically flexible, and may be of varying length depending on the application for which they are intended. Otherwise identical cables may be sold in a variety of selected lengths so that individual consumers may choose the one that is most suitable. Typically, this means that the consumer will arrange their electrical components, such as those associated with a TV or stereo system, and then determine the length of cable needed to connect the various components to each other. Often these cables are supplied with the components that will need to be attached to one another, but frequently the cables are purchased separately as well.

At one time, it was common to use wires or cables that simply terminated. The consumer would select a cable of appropriate length, then strip away a small amount of the insulating material and wrap the exposed conductor portion around a screw, or insert it into a clamp to complete the connection. More recently, however, in order to make for more convenient use by the consumer, each end of the cable is now typically equipped with a suitable connector. These cable connectors may come in a wide variety of configurations. As might be expected, however, standards evolved or were promulgated for certain commonly-used electrical connectors so that a wide range of components may be interconnected using the same basic cables. While there are many different types, a few standard connectors are very popular.

One popular type of electrical connector is often referred to as an RCA connector or, more recently, as an audio-video (or simply A/V) connector. Cables featuring these connectors are frequently used to connect different components in, for example, a home entertainment system. Such systems may typically have at least three or four components, but may have as many as a dozen or more. Sometimes more than one cable will be required to connect any two components together. Note, however, that while these connectors will be primarily discussed as attached to the ends of cables, there must also be a compatible connector on the system component or other device being connected.

FIG. 1 is an illustration of a typical A/V connector pair 100 as viewed from the side. Each connection must, of course, be made of two corresponding connectors that, while not identical, are made to join with each other to form a secure electrical connection. (Making both corresponding connectors identical to each other, or nearly so, is possible but rare in current industry practice for this particular application.) In the case of A/V connectors, one-half of this connection pair will herein be referred to as a "jack," and the other half will be referred to as a "plug", although other names (for example "female" and "male") may be used as well. In the example of FIG. 1, the A/V cable jack is designated 150, and the plug 110. In many cases, a particular cable will have a plug at each end, with each plug connectable with a jack located on a system component. At other times, of course, a cable might also have two jacks, one on each end, or a jack on one end and a plug on the other.

In the connector pair of FIG. 1, jack 150 is at the end of cable 149, which in this example (and as described above) includes two conductors separated from each other by an insulating material, and this whole assembly is surrounded by an insulating exterior. Jack 150 includes a body 155 that not only houses the electrical connection (not shown) between the cable conductors themselves and the electrically conductive portions of the jack connector, but also provides a convenient place for the consumer to grip the connector when connecting or disconnecting it. For additional security, a gripping surface 156 is formed in body 155 by scoring an enlarged portion of its exterior. If body 155 is molded from a thermoplastic material, as is not atypical, gripping area 156 may also be produced in the molding process. A grip may also be a separate component that has been fabricated from a suitable material and in some fashion secured into place. In the connector jack 150 of FIG. 1, a flexing section 157 is also formed in the body 155 to permit the end of the body to flex as the cable 149 is moved from side to side.

Protruding from body 155 is a barrel 160, which is made of a conducting material that is electrically connected to one of the cable 149 conductors within body 155. The barrel is typically cylindrical in shape, though other shapes may be used as well so long as they are compatible with the desired plug type. The interior of the barrel 160 is filled with a dielectric material that forms a central recess in which a second conductor is disposed (see FIG. 2). This second conductor will sometimes be referred to as part of a receptacle.

Corresponding portions of the A/V cable plug 110 will make contact with these conductors. In the illustration of FIG. 1, connector plug 110 is disposed at the termination of cable 109. Body 115, as in the body 155 of jack 150, houses the electrical connections (not shown) between the conductors of plug 110 and those of cable 109. In the plug 110 of FIG. 1, these conductors are sleeve 120 and probe 130. To form connection, jack 110 and plug 150 are moved into engagement in the direction of the arrows above FIG. 1. The manner in which the two connectors mate when engaged may be easily understood by reference to FIG. 2.

FIG. 2 is an isometric view of the A/V connector pair 100 of FIG. 1 (reoriented to show certain features). Referring first to connector jack 150, it can here be seen that the interior of barrel 160 includes a dielectric cylinder 162, which functions to structurally separate the two connector conductors. Dielectric cylinder 162 forms an opening 163, in which is disposed receptacle conductor 164. Correspondingly, in it can be seen in FIG. 2 that probe 130 of connector plug 110 extends from the middle of floor 121 of sleeve 120. More specifically, floor 121 forms an opening 123. Dielectric ring 122 is disposed within opening 123, and itself forms an opening 124 through which extends probe 130. Dielectric ring 122 provides for electrical isolation between the probe 130 and the floor 121 of sleeve 120.

When the connector pair is assembled (as indicated in FIG. 1), the outer wall 161 of barrel 160 connects electrically with the interior wall 126 of sleeve 120, thereby forming one of the two electrical connections (typically the ground). The second electrical connection is formed when probe 130 is received in the opening 163 and contacts the receptacle conductor 164. In addition, the mechanical interaction of sleeve 120 and barrel 160, and of probe 130 and receptacle connector 164, tend to secure the jack 150 and plug 110 together in an assembled configuration (not shown) until a sufficient separating force is applied to pull them apart. Naturally, the closer in size these corresponding components are, the more secure the fit. Although a barrel or probe that is too large would resist being received into the sleeve or receptacle, respectively, if they are relatively no smaller than necessary for the connection to occur, they will tend to require a greater applied force to separate the plug and jack. Up to a reasonable limit, greater security is preferred, and helps to ensure a good-quality electrical connection as well.

Unfortunately, these corresponding parts of the connectors may vary somewhat in size from manufacturer to manufacturer and from application to application. This may be intentional, or may be due to manufacturing tolerances that allow for the variation. Too great a deviation, of course, will result in a connector not being able to connect at all, or in a loose connection that is too easily broken. Over time, wear and plastic deformation may also occur, degrading the quality of the connection. Easily broken or faulty connections such as these often mean that the entire cable terminated at the connector will have to be replaced. Not only does the consumer in this case have to purchase another cable, but replacement can be difficult where, as is not uncommon, the cables and the connections they provide are hidden in hard-to-access locations. In some cases, faulty connections may even cause damage to other system components as well. For these reasons, an improved connector design is needed so as to accommodate small variations in the size of various components due, for example, to manufacturing tolerance differences or wear and tear. The connector of the present invention provides just such a solution.

SUMMARY OF THE INVENTION

The present invention is directed to an improved electrical connector for use, for example, on the ends of audio visual cables. The connectors are advantageously employed to improve the interconnection between various electrical devices. These devices may be system components, other cables, or simply hubs for connecting two or more cables together.

In one aspect, the present invention in an electrical connector having a body and a sleeve, the body for housing a connection between a cable conductor and the sleeve. The sleeve, which may be cylindrical in shape, extends outwardly from the body to electrically and mechanically engage a corresponding member of another connector. The sleeve forms at least one slot extending from the end of the sleeve toward the connector body, preferably at approximately a 90 degree angle to a plane defined by the sleeve's distal end. The slot intersects another slot, preferably at an intersection of approximately 90 degrees. (These slots may also be considered different portions of the same slot.) The second slot, or slot portion, extends from the intersection in a least one direction along the periphery of the sleeve. The second slot may also extend in two opposing directions. Preferably, the second slot or slots will extend just over one-half way around the sleeve's periphery. Additional slots (or slot portions) may also be present, being added for structural or aesthetic reasons.

In another aspect, the present invention is a sleeve for use in an electrical connector, the sleeve forming two slots disposed on two generally opposing sides of the sleeve. Each of the two slots has a longitudinal portion and at least one lateral portion. The lateral portions of the two respective slots may offset with respect to the end of the sleeve so that they do not intersect each other. One or both of the slots may have more than one lateral portion extending along the sleeve periphery. In one embodiment, the sleeve is for use on a plug connector such as those affixed to the end of A/V, or RCA type cables. The sleeve may be a conductor associated an electrical connecter, or it may be for the purpose of maintaining the connector in a mechanically connected configuration.

In yet another embodiment, the present invention is an electrical connector for providing an electrical connection to an electrical cable having a pair of conductors, the electrical connector including a longitudinally-extending conductive probe electrically connected to a first lead of the electrical cable; a conductive sleeve positioned about the longitudinally-extending conductive probe, the conductive sleeve spaced apart from and electrically isolated from the longitudinally-extending probe and electrically connected to a second lead of the electrical cable; a slot member formed at said conductive sleeve and defining a channel extending through at least a portion thereof, the slot member commencing at a distal end portion of the conductor sleeve and including an angled part extending in a direction offset from a longitudinal direction defined by the longitudinally-extending conductive probe.

As more complete appreciation of the present invention and the scope thereof can be obtained from the accompanying drawings that are briefly summarized below, the following detailed description of the presently-preferred embodiments of the present invention, and the appended claims.

BRIEF DESCRIPTION OF THE DRAWINGS

For a more complete understanding of the present invention, and the advantages thereof, references made to the following drawings in the detailed description below.

DETAILED DESCRIPTION

FIGS. 1 through 18, discussed herein, and the various embodiments used to describe the present invention are by way of illustration only, and should not by construed to limit the scope of the invention. Those skilled in the art will understand the principles of the present invention may be implemented in any suitable electrical connector, in addition to the devices specifically discussed herein.

The present invention is directed to a connector, and specifically an electrical connector for use in applications in which connections are to be made and broken (that is, connected and disconnected) easily and repeatedly. As mentioned above, one such application involves the interconnection of the various components of a home-entertainment system. Generally speaking, this interconnection is accomplished using various cables, each of which may form a separate communication or control channel. In some cases, these interconnecting cables may also carry power at low levels, for example for operating certain audio speakers. (AC power for components is typically drawn through a power cord using a standard AC plug that plugs into a wall outlet; the connector of the present invention is generally not suitable for this purpose.) In this type of system, the consumer places the various components in the desired location and then connects them using the A/V (or similar) cables. Some consumers may alter the system configuration frequently, meaning that certain components will be unplugged and others connected or reconnected. While making these connections should be convenient for the consumer, the connections nevertheless must be reliable so that audio- and video-presentation quality remains high.

Figure 1:
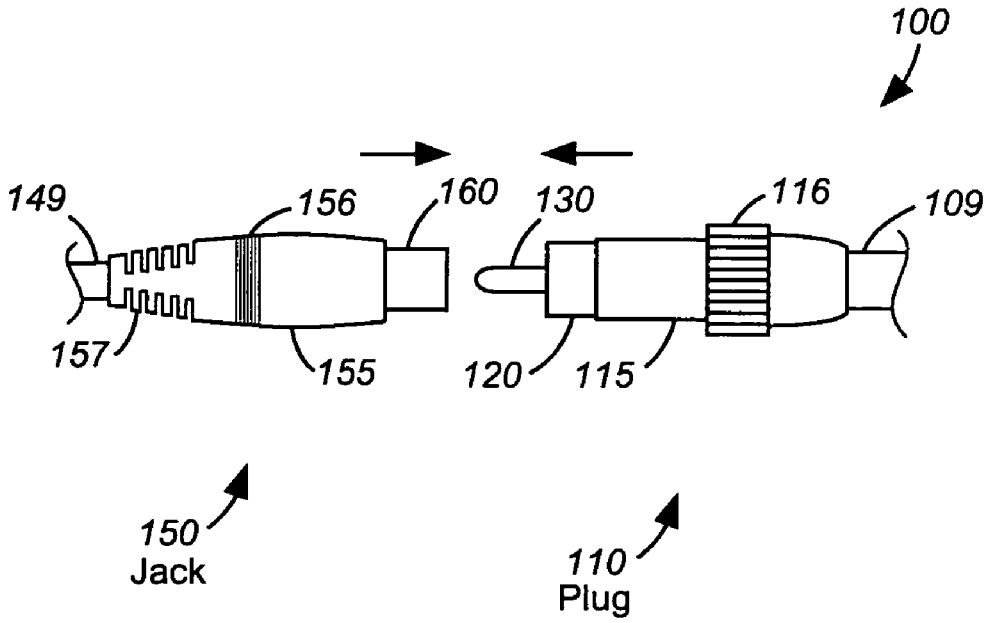
Figure 1 (Prior Art)
FIG. 1 is an illustration of a typical A/V connector pair as viewed from the side.
Figure 2:
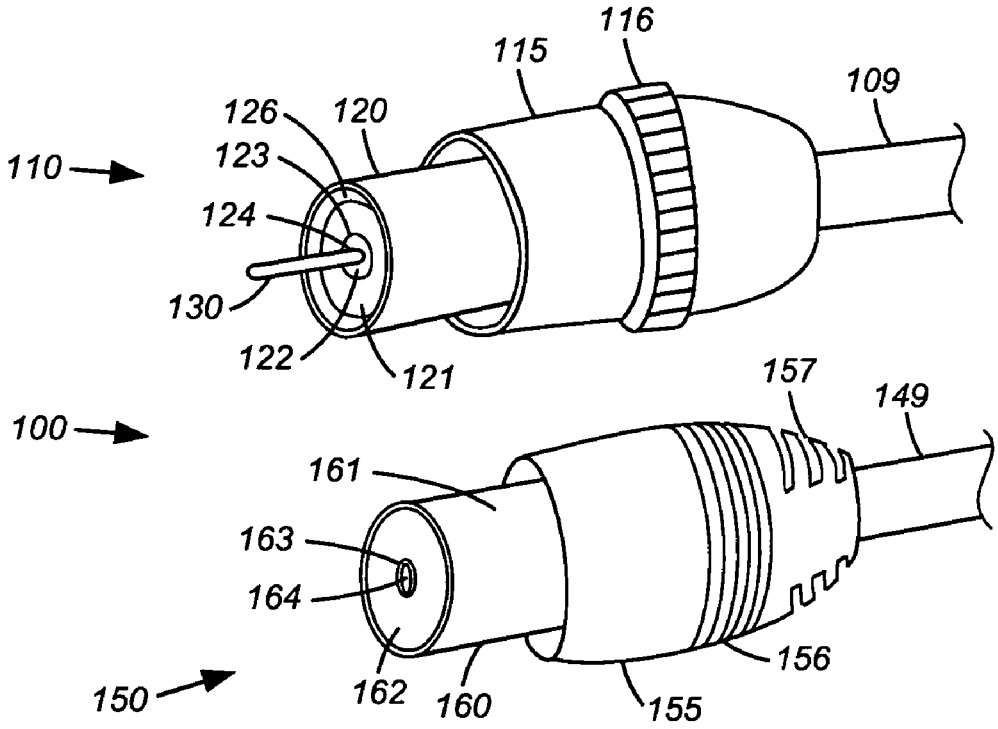
Figure 2 (Prior Art)
FIG. 2 is an isometric view of the A/V connector pair of FIG. 1.
Figure 3:
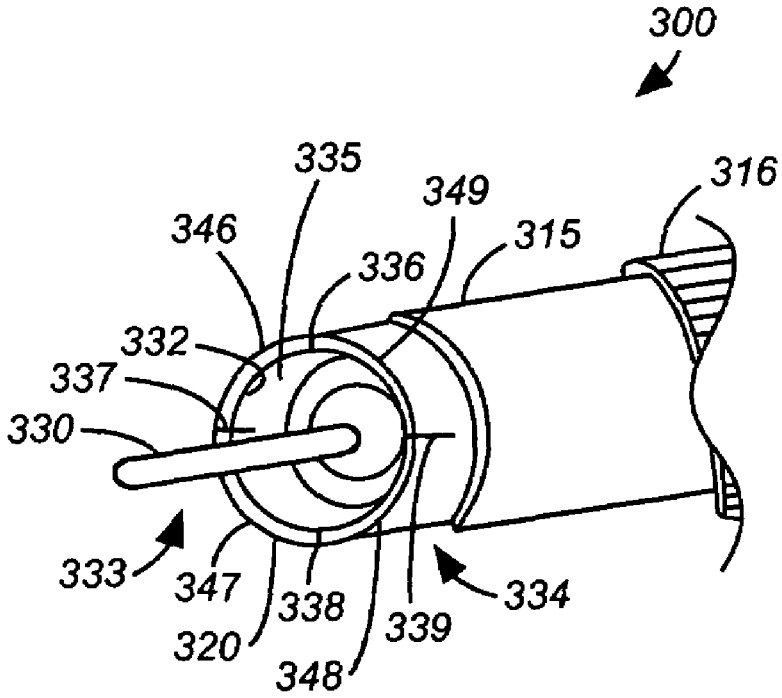
Figure 3 (Prior Art)
FIG. 3 is an illustration of an A/V cable plug connector having a split sleeve.

As mentioned above, however, there are obstacles to producing connectors that perform well in all applications and consistently over time. One somewhat-effective solution is the use of a split sleeve. An example will now be illustrated. FIG. 3 is a partial isometric illustration of an A/V cable plug connector 300 having a split sleeve. Note that connector 300 is a modest variation of the jack 110 of FIGS. 1 and 2, and several of the features explicitly referred to there will appear in FIG. 3 although the discussion of them will not be repeated. Connector 300 includes a body 315 that houses the actual connections (not shown) between the conductors of a cable (also not shown) and the probe 330 and sleeve 320. Grip 316 is a contoured portion formed with body 315.

As with the previously-described plug connector, the plug 300 of FIG. 3 will establish the intended connection when sleeve 320 is advanced over the barrel of a jack connector (see, for example, jack 150 of FIG. 1), such that the jack barrel is received into recess 335 formed by sleeve 320. At the same time, probe 330 will be received into a receptacle formed in the center of the barrel.

As it usual in this type of connector, the probe 330 engages a corresponding contact positioned within a jack receptacle to establish one electrical connection, and the inner surface 332 of sleeve 320 engages the outer surface of the jack connector barrel to establish a second. To enhance the reliability of this connection, the recess 335 formed by sleeve 320 is slightly smaller than the outer diameter of the barrel it is to receive. Cuts 336, 337, 338, and 339, however, are made through the sleeve 320, extending from the sleeve distal end 333 toward the proximate end 334. The sleeve 320 is formed of such a material and thickness that when sufficient force is applied as the connector 300 is advanced into correspondence with a jack connector, the sections 346, 347, 348, and 349 formed by cuts 336 through 339 will each flex elastically outwardly a small amount to permit the barrel to be fully received notwithstanding its size relative to the recess 335 formed by the non-flexed sleeve 320.

The cuts 336 through 339 are typically formed along part, though not all of the length of sleeve 320 from its distal to proximate ends. The reason for this, as should be apparent, is to leave an uncut section at the base (proximate end) of sleeve 320. Cuts 336 through 339 may also be enlarged to form slots, the distinction being that in this configuration the sections 346 through 349 may not contact each other even in their fully-relaxed position. In other words, as used herein a cut may be thought of simply as a narrow slot.

Using somewhat the same principle, the receptacle (not shown) into which probe 330 will be received may form cuts (or slots) to allow it to expand a small amount when probe 330 is inserted. A receptacle made from multiple spring-loaded components may also be used to similar effect. The tendency of the sleeve 320 and the receptacle to return to their unexpanded dimensions biases them against the portions of the connector jack to which they become adjacent in a connected configuration, and thereby assists in ensuring a better electrical connection and more secure mechanical one. There are, however, limits to the advantage of simply splitting the sleeve. A far more satisfactory result may be achieved using the embodiments of the present invention that will now be described.

Figure 4:
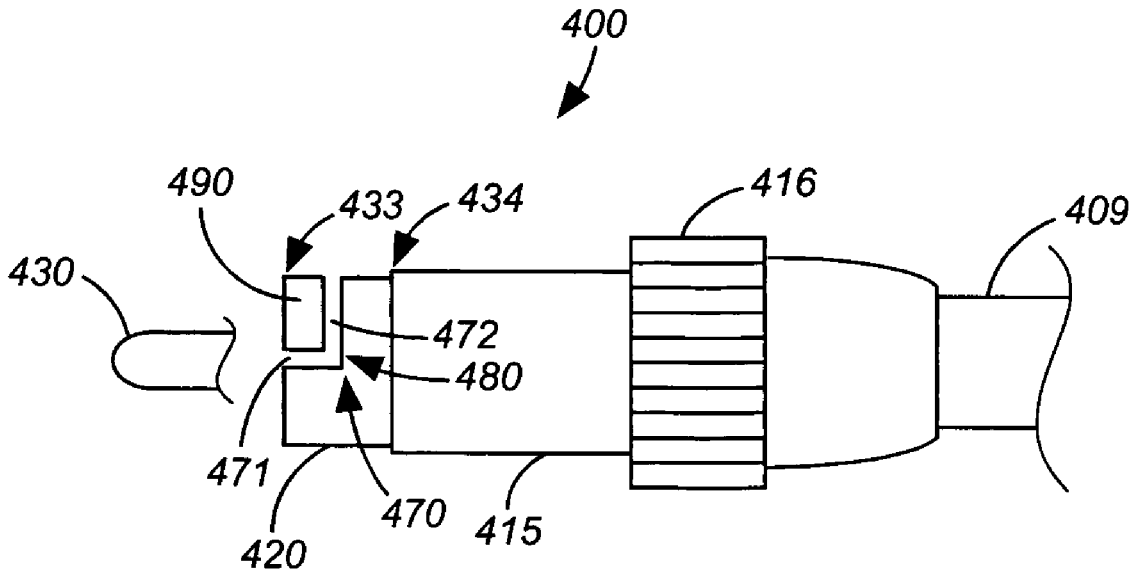
FIG. 4 is an illustration of a connector plug according to an embodiment of the present invention.

FIG. 4 is an illustration of a connector plug 400 according to an embodiment of the present invention. In this embodiment, cable 409 is received into one end of the body 415 of connector 400. Grip 416 surrounding a portion of body 415 to aid in holding the connector 400 during connection and disconnection. Although the cable entry point is typically at one end of the connector, however, the cable may of course enter the connector body at any location that does not interfere with establishment of the desired connections. Within the body 415, electrical contact is made between the cable's conductors (not shown) and the probe 430 and sleeve 420 of connector 400. Note that using the probe and the sleeve as conductors is typical in this type of connector, but it is not a requirement of the invention unless explicitly recited. In another embodiment (not shown), for example, there may be two probes (or none), or the sleeve or probe may be used only for structural support and not as an electrical connection at all. Note also that in FIG. 4, probe 430 has been partially cut-away to more clearly illustrate other features.

In accordance with this embodiment of the present invention, the sleeve 420 of connector 400 forms a slot 470 that extends in at least two directions from intersection 480. Here, slot 470 includes a first portion 471 and a second portion 472. The illustration of the slot 470 in FIG. 4 is not necessarily intended to show its size relative to sleeve 420 and the remainder of connector 400. In most applications, the slot or slots used will be relatively much narrower, but the slot size has been exaggerated for clarity. The exact dimensions or extent of any slot or slot portion is not material to the invention unless explicitly recited.

In the embodiment of FIG. 4, first slot portion 471 extends longitudinally from intersection 480 to the distal end 433 of sleeve 420. Second slot portion 472 extends along the perimeter of sleeve 420 such that intersection 480 forms an angle of approximately 90 degrees. There is no requirement (unless explicitly claimed) for the length of second slot portion 472, although the greatest advantage obtains when it extends along just over 180 degrees of the sleeve perimeter. Slot 470 thereby forms a clip 490, sometimes referred to herein as a "C-clip", extending along the periphery (when viewed from the end) of sleeve 420. It has been found that in most cases, forming one or more C-clips in this manner greatly improves the performance of the connector, although measurable performance improvement is not a requirement of the present invention unless explicitly recited.

Figure 5:
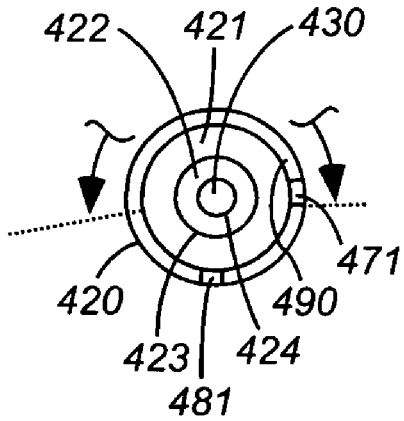
FIG. 5 is an end view of the sleeve and probe of the connector of FIG. 4, as viewed from its distal end.

FIG. 5 is an end view of the sleeve 420 and probe 430 of the connector 400 of FIG. 4, as viewed from the distal end 433. Note that in this view, probe 430 may be seen disposed in opening 424, opening 424 being formed in insulating ring 422 for this purpose. Insulating ring 422, in turn, is disposed in an opening 423 formed in the floor 421 of sleeve 420. In this manner probe 430 is held securely in position and isolated electrically from sleeve 420. Clip 490 is shown, as it the longitudinal first portion 471 of slot 470. Second slot portion 472, not visible in this view, extends counterclockwise from the intersection 480 (see FIG. 4), but its extent is illustrated by the curved arrows in FIG. 5. In the embodiment of FIGS. 4 and 5, slot second portion extends in one direction from intersection 480 approximately one-half of the way around the periphery of sleeve 420. This length of extension may vary according to the preferences established for each application. Slot 481 is, in this embodiment, a second slot formed in the side of sleeve 420 (and is entirely optional). Slot 481 has, in the embodiment of FIGS. 4 and 5, approximately the same orientation and extent as the first portion 471 of slot 470.

Note that as used herein, a slot is an elongated opening formed in a structure. In the context of the present invention it is an elongated opening or cut formed in the sleeve of an electrical connector (or in some other connector structure that performs a similar function). In most instances the slot extends all, or substantially all of the way through the sleeve or other structure in which it is formed. A slot portion is defined by an end of the slot and another end or an intersection at which the orientation of the slot changes. The orientation of a slot portion means the direction of its elongation relative to the connector. If the slot portion is not straight, then its orientation is defined by the relative direction of a line passing through its end points.

Figure 6:
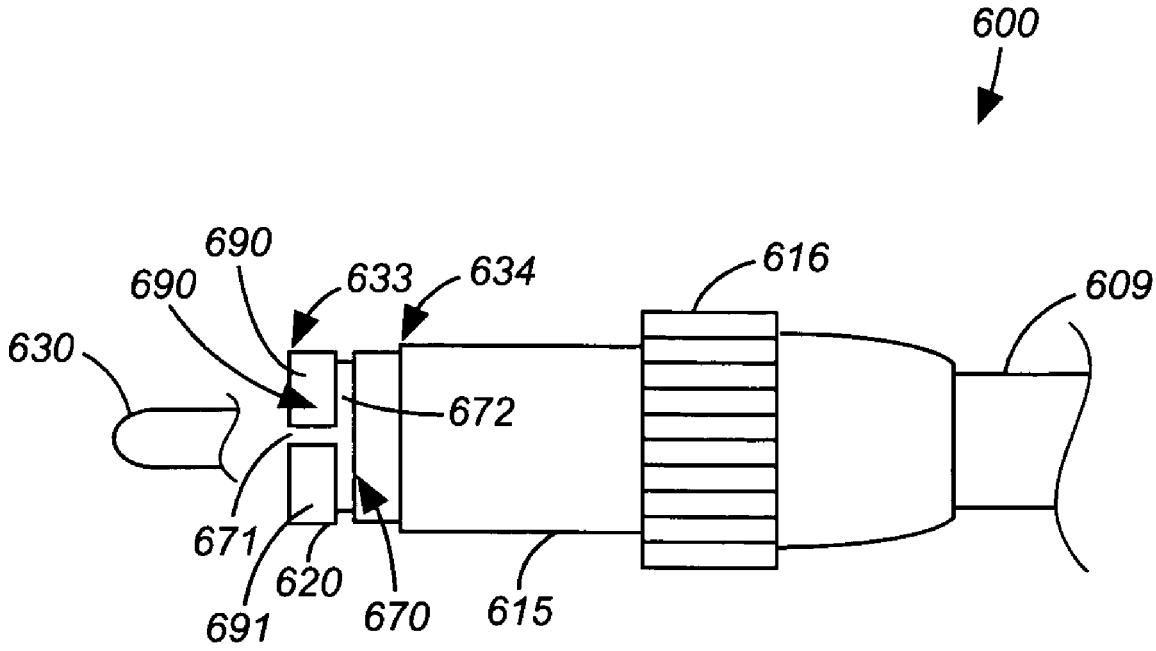
FIG. 6 is an illustration of a connector plug according to another embodiment of the present invention.
Figure 7:
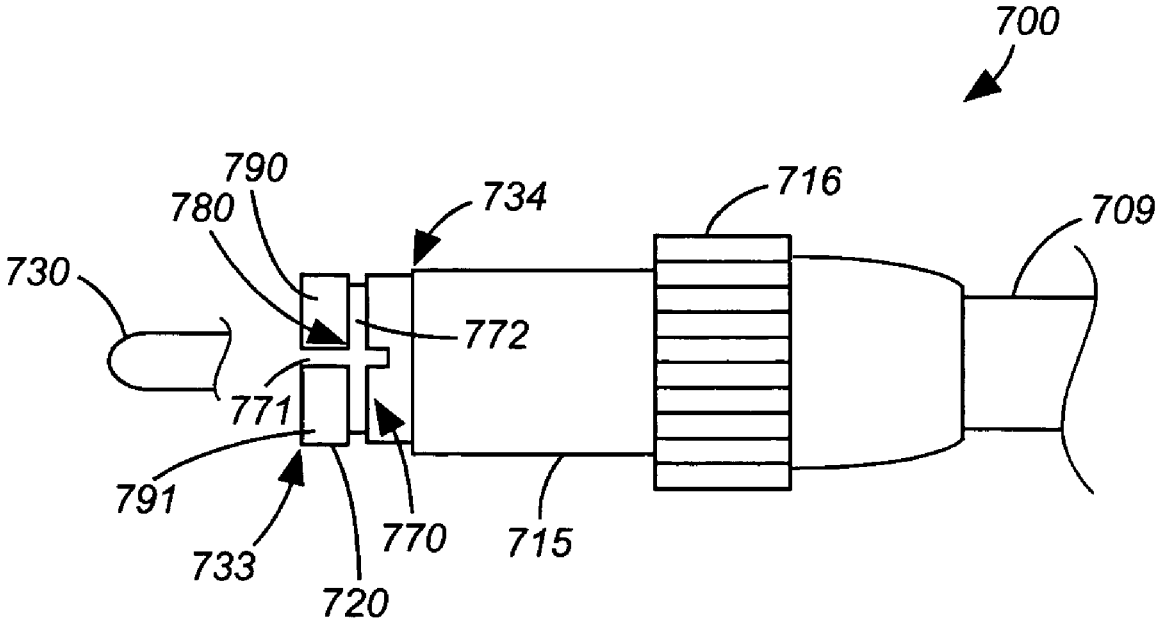
FIG. 7 is an illustration of a connector plug according to another embodiment of the present invention.

FIG. 6 is an illustration of a connector plug 600 according to another embodiment of the present invention. As before, cable 609 is received into one end of the body 615 of connector 600. Grip 616 surrounding a portion of body 615 to aid in holding the connector 600 during connection and disconnection. Sleeve 620 extends distally from the body 615 of connector 600, and probe 630 essentially extends in the same direction from the floor (not shown) of sleeve 620. In the embodiment of FIG. 6, slot 670 includes a first portion 671 that extends from the distal end 633 of connector 600 to an intersection 680. The second portion 672 of slot 670 extends peripherally in two, opposing directions from intersections 680, forming two clips 690 and 691. Again, the size of the slot relative to the other connector components may vary, and is somewhat exaggerated in FIG. 6 for clarity of illustration. FIG. 7 is an illustration of a connector plug 700 according to another embodiment of the present invention. Connecter plug 700 is identical to connector plug 600 of FIG. 6, except that in the embodiment of FIG. 7, the first portion 771 of slot 770 extends beyond intersection 780 (in the direction of proximal end 734 of sleeve 720). The other features of connector 700 are the same as those of connector 600, and analogously numbered for reference, and so further description of them will be omitted.

Figure 8:
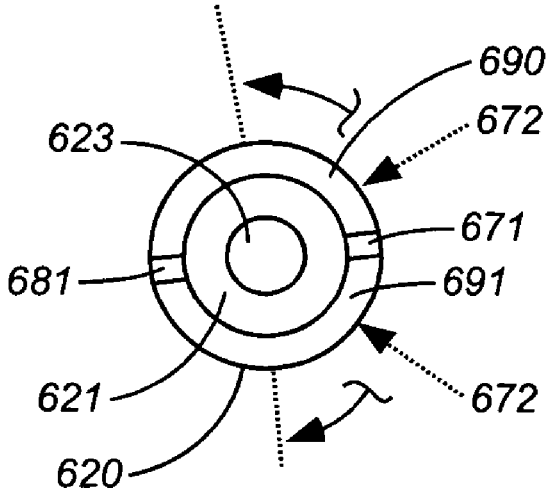
FIG. 8 is an end view of the connector of FIG. 6, as viewed from its distal end.

FIG. 8 is an end view of the connector 600 of FIG. 6, as viewed from the distal end 633. Note that in this view, opening 624 may be seen but probe 630 and insulating ring 622 have been omitted for simplicity. Clips 690 and 691 are shown, as it the longitudinal first portion 671 of slot 670. The location of second slot portion 672, not visible in this view, is shown by broken arrows, and its extent is (both clockwise and counterclockwise) from the intersection 680 (see FIG. 6) is illustrated by the curved arrows in FIG. 8.

In the embodiment of FIGS. 6 and 8, second slot portion 672 extends in two opposite directions from intersection 480 approximately one-quarter of the way around the periphery of sleeve 620 in each direction. This length of extension may vary according to the preferences established for each application, and the extension distances of second slot portion 672 in each direction need not be the same. It is preferred in this embodiment, however, that the second slot portion 672 extend along the sleeve 620 for just over one-half of its perimeter. Slot 681 is, in this embodiment, a slot formed on the opposing side (as viewed from the end) of sleeve 620. Slot 681 has, in the embodiment of FIGS. 6 and 8, approximately the same orientation and extent as the first portion 671 of slot 670 (but could be different as well). Note that the illustration of FIG. 8 also, in essence, shows an end view of the connector 700 of FIG. 7, since the distinction between the embodiments of FIGS. 6 and 7 is not visible when the connectors are viewed from their respective distal ends.

At this juncture, it will be noted that some variation from the embodiments presented above is possible, and may be desirable in some applications. For example, in each case above, the orientation of a first slot portion differed from that of a second slot portion by approximately (or exactly) 90 degrees. In accordance with the present invention, however, the difference in orientation from one slot portion to an intersecting slot portion may range from 45 to 135 degrees, although an intersection of approximately 90 degrees is presently preferred for most applications. By the same token, the slot portion originating at the distal end of a connector sleeve may vary by as much as 45 degrees from an orientation parallel with the central axis of the connector. A first slot portion may in fact intersect with more than one addition slot portions (for example if two slot portions extend from an intersection in different but not opposing directions). And a second slot portion may intersect with both a first and a third slot portion.

Even in a more standard implantation, more than one multi-portion slot may be used. FIGS. 9*a* through 9*d* are successive partial side views of a sleeve structure 901 in accordance with another embodiment of the present invention. The sleeve structure 901 includes a sleeve 920, such as those that have been illustrated in various other figures and described above. Sleeve structure 901 also includes a cable tunnel 924 in to which the cable itself will actually be received. In between sleeve 920 and cable tunnel 924 is a threaded portion 925 for engaging a corresponding threaded portion on the inside of the connector body (not shown) when the connector is assembled. These features of sleeve structure 901 are, however, exemplary and many other configurations are possible.

Figure 9A:
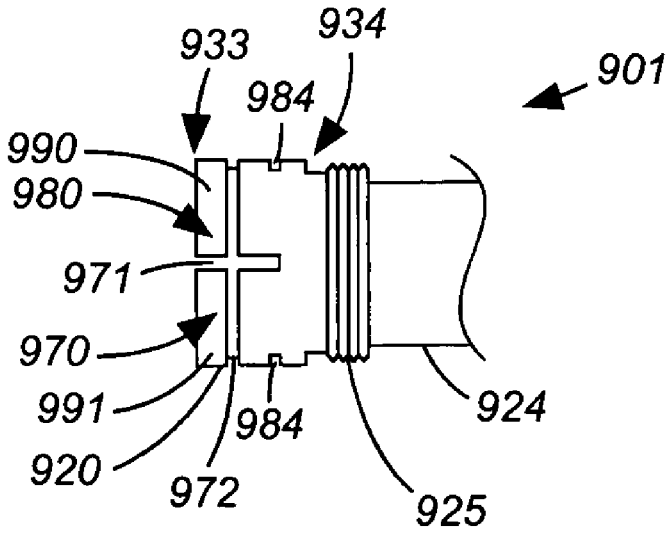
FIGS. 9*a* through 9*d* represent side views of a sleeve structure for an electrical connector as it is rotated about its central access in 90 degree increments.

FIGS. 9*a* through 9*d* represent side views of the sleeve structure 901 as it is rotated about its central access in 90 degree increments (the top being rotated toward the viewer). In FIG. 9*a* slot 970 is entirely visible, though in this embodiment it extends slightly more than 180 degrees along the periphery of sleeve 920. Slot 970 includes a first portion 971 that extends at approximately 90 degrees from the distal end 933 of sleeve 920 toward the proximate end 934, passing intersection 980. At intersection 980, second slot portion 972 extends in opposite directions at approximately a 90 degree angle to first slot portion 971. Slot 970 forms C-clips 990 and 991 in sleeve 920.

Figure 9B:
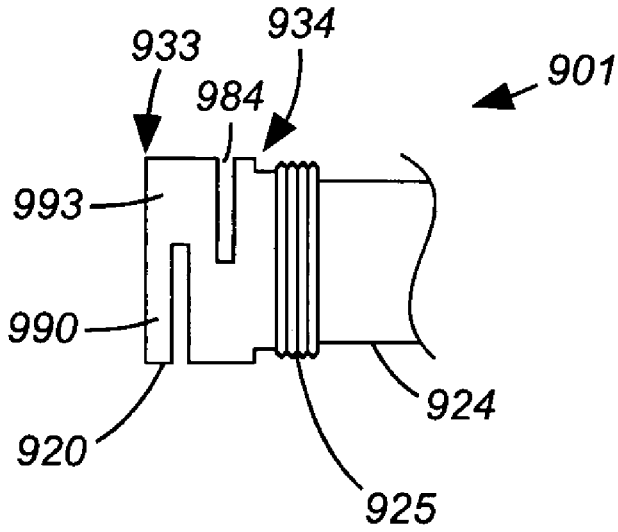
Figure 9C:
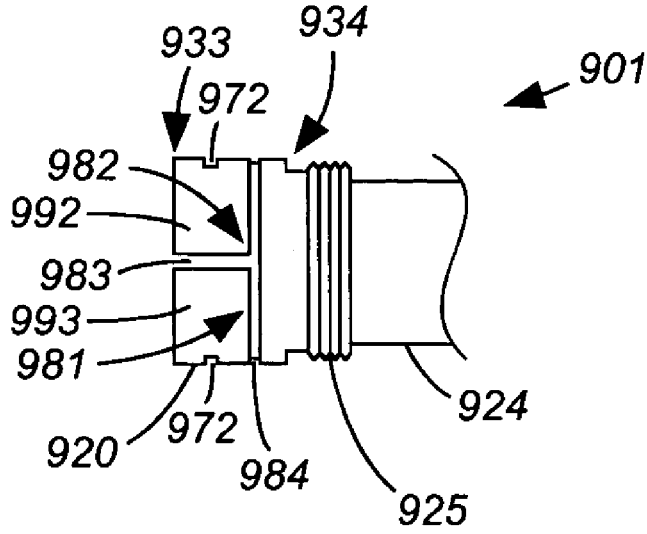

In FIG. 9*c*, slot 981 is entirely visible, though it also extends slightly more than 180 degrees along the periphery of sleeve 920 (but at a different location along the length of the connector sleeve than that of slot 970). First portion 983 of slot 981 extends at approximately 90 degrees from the distal end 933 of sleeve 920 toward the proximate end 934, in this instance terminating at intersection 982. At intersection 982, second slot portion 984 extends in opposite directions at approximately a 90 degree angle to first slot portion 983. Slot 981 forms in sleeve 920 C-clips 992 and 993 (which themselves form portions of slot 970). The sleeve 920 of FIGS. 9*a* through 9*d* may be said to exhibit a "double C-clip" configuration.

Figure 9D:
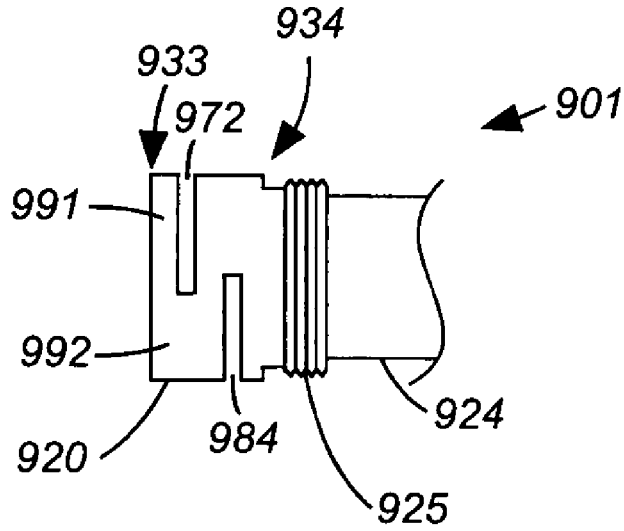

In FIGS. 9*b* and 9*d*, the sleeve structure 901 is respectively shown from opposing side views. Different parts of the second slot portion 972 are visible in each of these figures, as are different parts of second slot portion 984. The relationship of the clips 990 through 993 may also be seen. Note that although respective first slot portions 971 and 983 appear to be approximately the same length, this is not necessarily the case. Nor is it a requirement that they both extend from the distal end 933 at the same angle, or from opposing locations with respect to each other. Similarly, there is no requirement that the second slot portions 972 and 984 have the same length, or that they extend parallel to each other around the periphery of sleeve 920, or that they both extend in two directions from their respective intersections with a first slot portion.

Figure 10A:
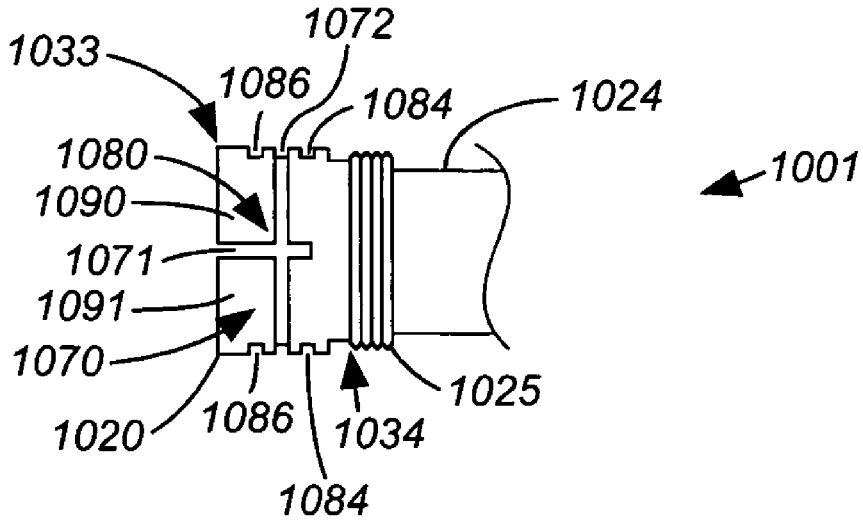
FIGS. 10*a* through 10*d* represent side views of a sleeve structure as it is rotated about its central access in 90 degree increments.

FIGS. 10*a* through 10*d* represent side views of a sleeve structure 1001 as it is rotated about its central access in 90 degree increments (the top being rotated toward the viewer). In FIG. 10*a* slot 1070 is entirely visible, extending slightly more than 180 degrees along the periphery of sleeve 1020. Slot 1070 includes a first portion 1071 that extends at approximately 90 degrees from the distal end 1033 of sleeve 1020 toward the proximate end 1034, passing intersection 1080. At intersection 1080, second slot portion 1072 extends in opposite directions at approximately a 90 degree angle to first slot portion 1071. Slot 1070 forms C-clips 1090 and 1091 in sleeve 1020.

Figure 10B:
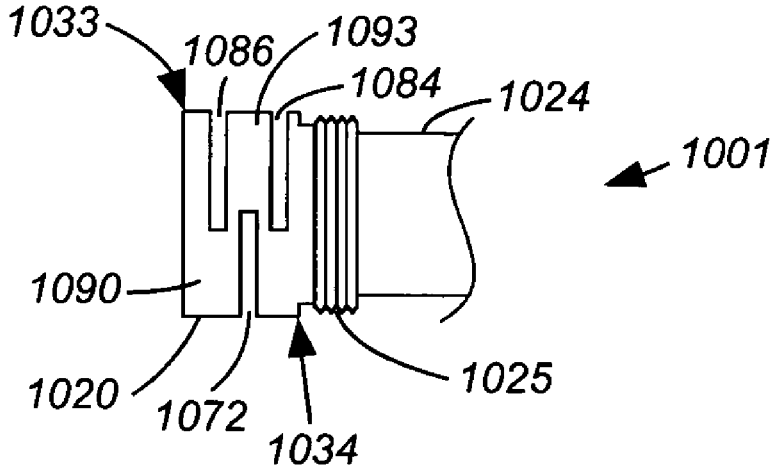
Figure 10C:
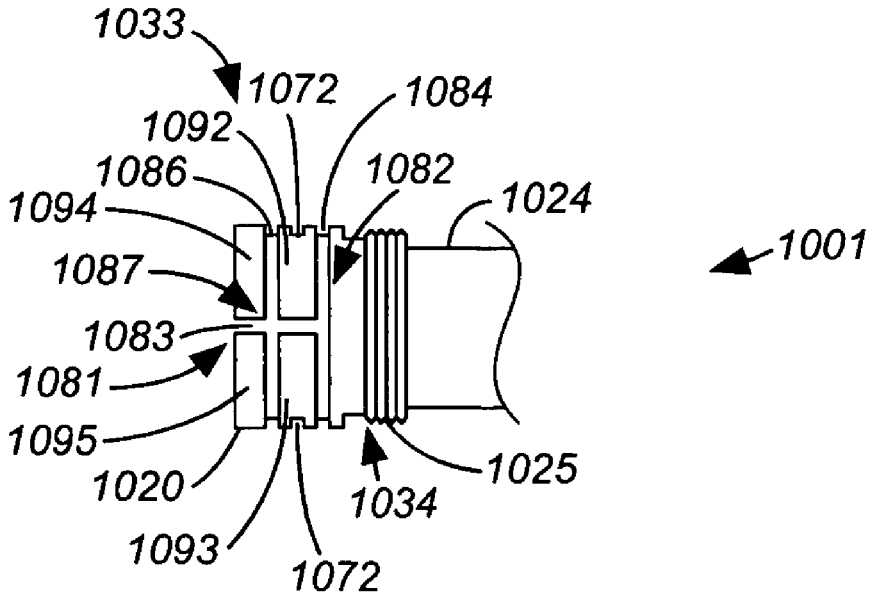

In FIG. 10*c*, slot 1081 is entirely visible, extending slightly more than 180 degrees along the periphery of sleeve 1020. First portion 1083 of slot 1081 extends at approximately 90 degrees from the distal end 1033 of sleeve 1020 toward the proximate end 1034, in this instance terminating at intersection 1082. At intersection 1082, second slot portion 1084 extends in opposite directions at approximately a 90 degree angle to first slot portion 1083. Slot 1081 forms in sleeve 1020 C-clips 1092 and 1093. In addition, in this embodiment, third slot portion 1086 extends in either direction from intersection 1087. In this embodiment, third slot portion 1086 of slot 1081, like second slot portion 1084, extends slightly more than 180 degrees along the periphery of sleeve 1020. Note, however, that this is not a requirement, nor do second portion 1084 and third portion 1086 have to be parallel to each other or to second portion 1072 of slot 1070. In this embodiment, third slot portion 1086 forms C-clips 1094 and 1095. The sleeve 1020 of FIGS. 10*a* through 10*d* may be said to exhibit a "triple C-clip" configuration.

Figure 10D:
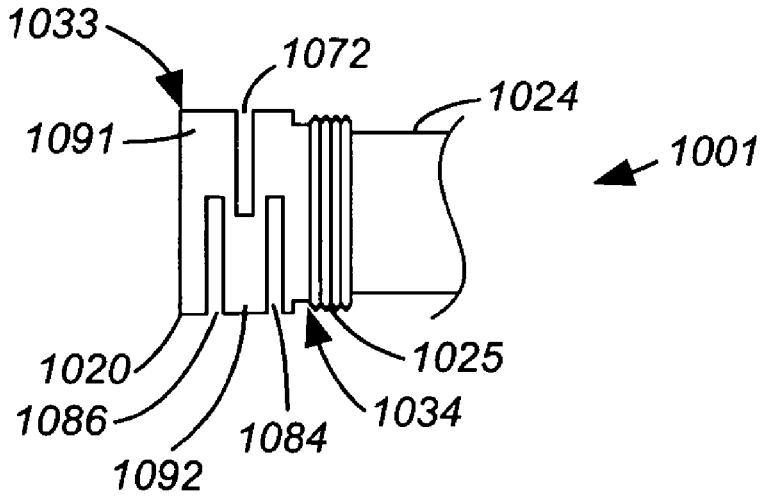

In FIGS. 10*b* and 10*d*, the sleeve structure 1001 is respectively shown from opposing side views. Different parts of the second slot portion 1072 are visible in each of these figures, as are different parts of second slot portion 1084 and third slot portion 1086. The relationship of the clips 1090 through 1095 may also be seen. Note that although respective first slot portions 1071 and 1083 appear to be approximately the same length, this is not necessarily the case. Nor is it a requirement that they both extend from the distal end 1033 at the same angle, or from opposing locations with respect to each other. The relative positioning of the various slot portions may of course be changed to accommodate individual preferences.

Figure 11:
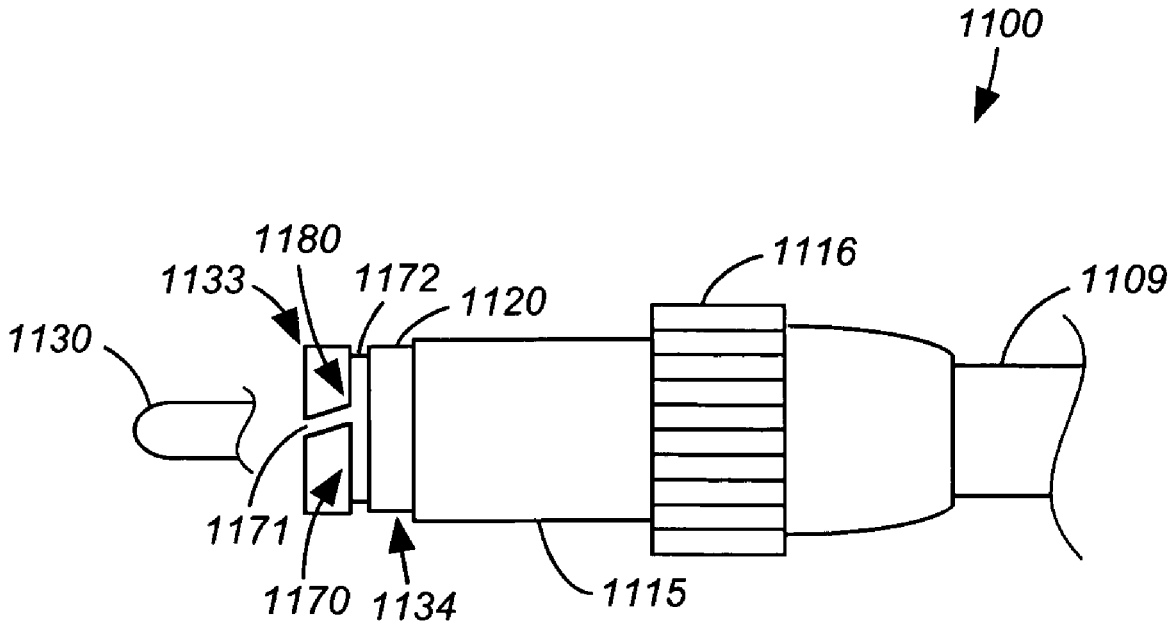
FIG. 11 is an illustration of a connector plug according to another embodiment of the present invention.

The connector of the present invention may vary in other respects as well. Several examples will now be briefly presented. FIG. 11 is an illustration of a connector plug 1100 according to another embodiment of the present invention. Connector plug 1100 is, in this embodiment, positioned at the terminus of cable 1109, and includes a body 1115 featuring a grip 1116. Probe 1130 and sleeve 1120 each facilitate both electrical and structural connections when the plug 1100 is engaged with a jack (not shown) or similar device. In the embodiment of FIG. 11, slot 1170 formed in sleeve 1120 includes a first slot portion 1171 extending from the distal end 1133 toward the proximate end of sleeve 1120, but at an angle of approximately 45 degrees. Second slot portion 1172 of slot 1170 extends in either direction from intersection 1180 at the terminus of first slot portion 1171. In this embodiment, a second slot (not shown) may or may not be formed in sleeve 1120 opposite the first portion 1171 of slot 1170.

Figure 12:
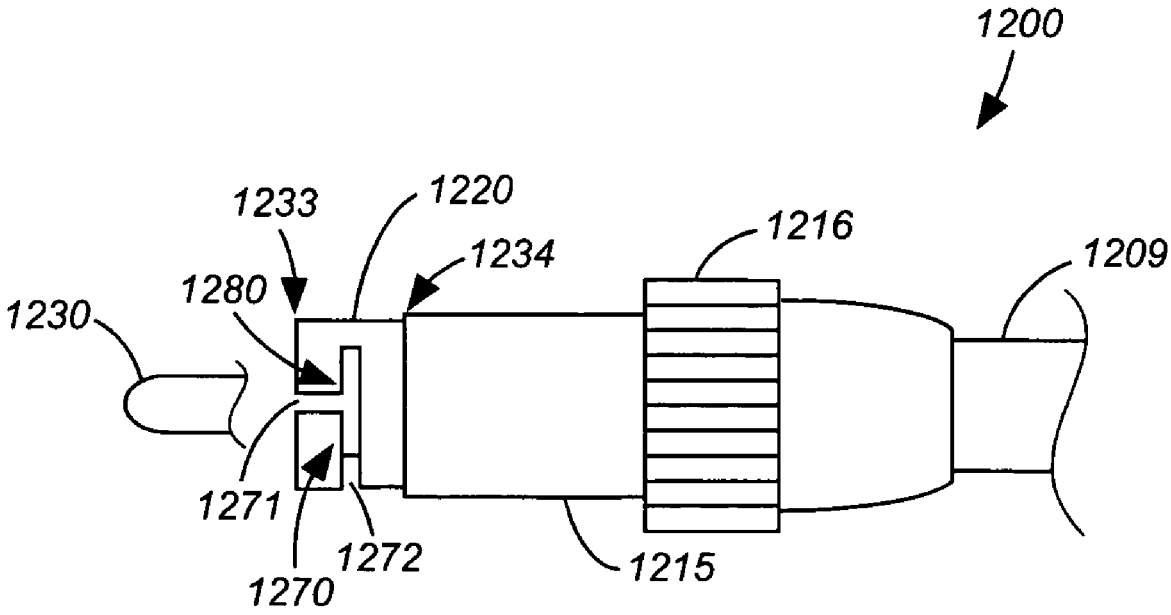
FIG. 12 is an illustration of a connector plug according to another embodiment of the present invention.
Figure 13:
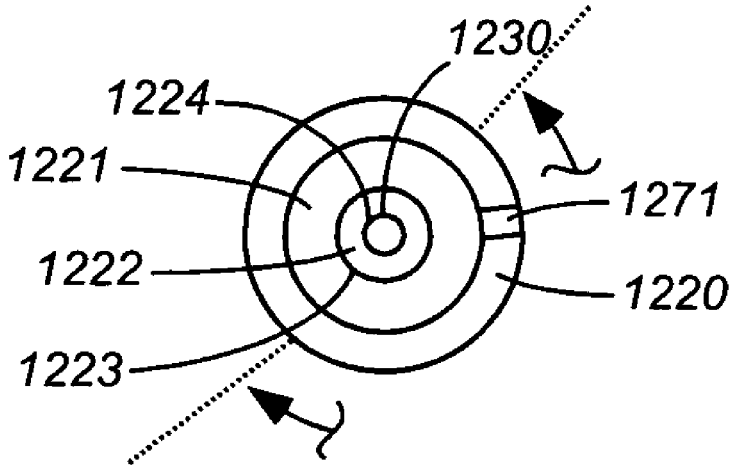
FIG. 13 is an end view of the sleeve and probe of connector of FIG. 12, viewed from its distal end.

Another variation is illustrated in FIGS. 12 and 13. FIG. 12 is an illustration of a connector plug 1200 according to another embodiment of the present invention. Connector plug 1200 is, in this embodiment, positioned at the terminus of cable 1209, and includes a body 1215 featuring a grip 1216. Probe 1230 and sleeve 1220 each facilitate both electrical and structural connections when the plug 1200 is engaged with a jack (not shown) or similar device. In the embodiment of FIG. 12, slot 1270 formed in sleeve 1220 includes a first slot portion 1271 extending from the distal end 1233 toward the proximate end of sleeve 1220 at an angle of approximately 90 degrees. Second slot portion 1272 of slot 1270 extends in either direction from intersection 1280 at the terminus of first slot portion 1271. As can be seen in FIG. 12, however, in this embodiment second slot portion 1272 extends relatively further in one direction than the other.

FIG. 13 is an end view of the sleeve 1220 and probe 1230 of connector 1200 of FIG. 12, viewed from its distal end 1233. In this view, probe 1230 may be seen disposed in opening 1224, opening 1224 being formed in insulating ring 1222 for this purpose. Insulating ring 1222, in turn, is disposed in an opening 1223 formed in the floor 1221 of sleeve 1220. First portion 1271 of slot 1270 is visible in this view. Second slot portion 1272 is not, but its extent in each direction from the intersection 1280 (see FIG. 12), is illustrated by the curved arrows in FIG. 13. The lengths of extension in either direction may of course vary according to the preferences established for each particular application.

Figure 14:
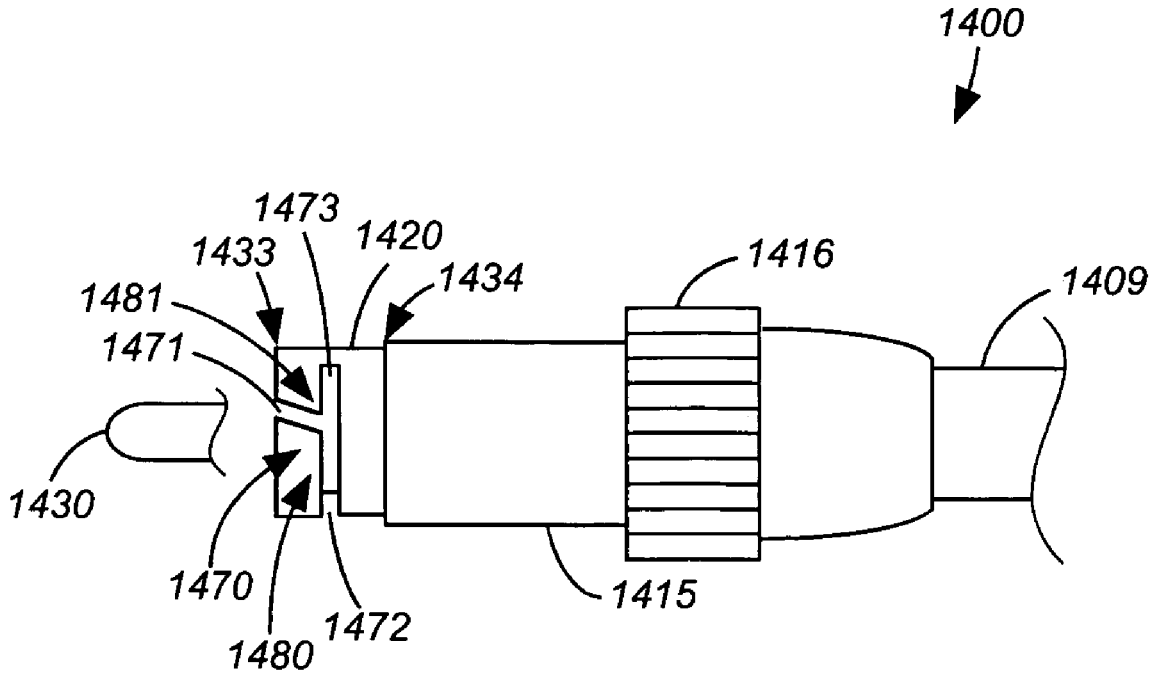
FIG. 14 is an illustration of a connector plug according to another embodiment of the present invention.

Another variation is illustrated in FIG. 14. FIG. 14 is an illustration of a connector plug 1400 according to another embodiment of the present invention. Connector plug 1400 is, in this embodiment, positioned at the terminus of cable 1409, and includes a body 1415 featuring a grip 1416. Probe 1430 and sleeve 1420 each facilitate both electrical and structural connections when the plug 1400 is engaged with a jack (not shown) or similar device. In the embodiment of FIG. 14, slot 1470 formed in sleeve 1420 includes a first slot portion 1471 extending from the distal end 1433 toward the proximate end of sleeve 1420 at an angle of approximately 45 degrees. Second slot portion 1472 of slot 1470 extends in one direction from intersection 1480 at the terminus of first slot portion 1471. In the embodiment of FIG. 14, third slot portion 1473 extends in the other direction not from intersection 1480, but rather from intersection 1481.

Figure 15:
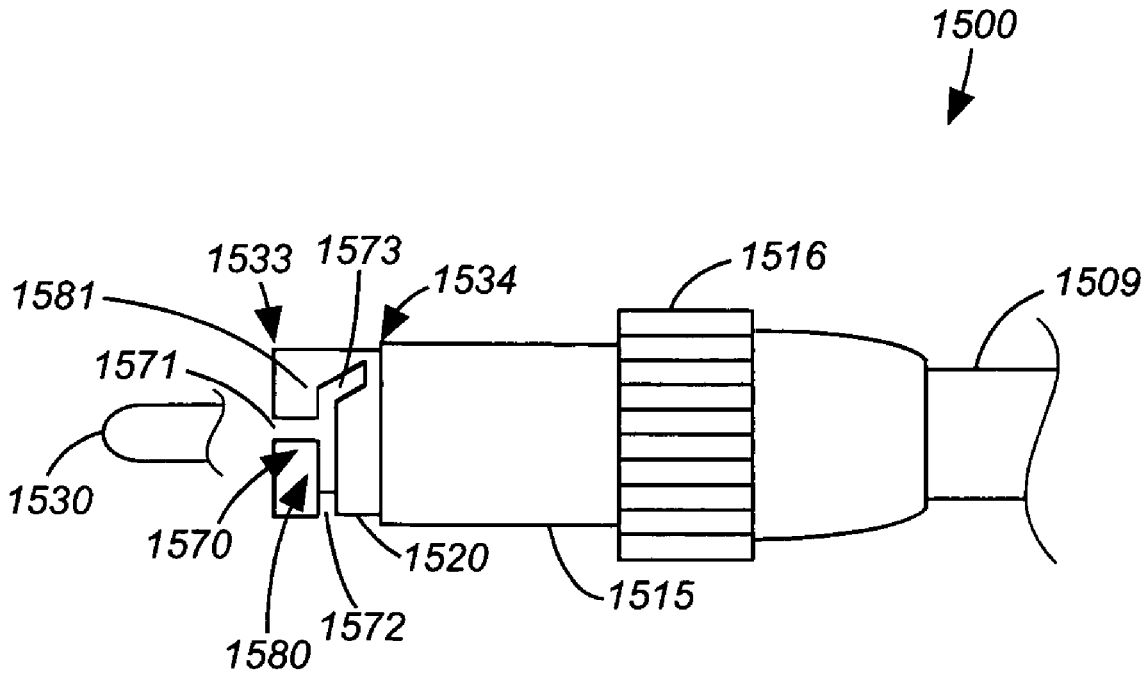
FIG. 15 is an illustration of a connector plug 1500 according to another embodiment of the present invention.

Another variation is illustrated in FIG. 15. FIG. 15 is an illustration of a connector plug 1500 according to another embodiment of the present invention. Connector plug 1500 is, in this embodiment, positioned at the terminus of cable 1509, and includes a body 1515 featuring a grip 1516. Probe 1530 and sleeve 1520 each facilitate both electrical and structural connections when the plug 1500 is engaged with a jack (not shown) or similar device. In the embodiment of FIG. 15, slot 1570 formed in sleeve 1520 includes a first slot portion 1571 extending from the distal end 1533 toward the proximate end 1534 of sleeve 1520 at an angle of approximately 90 degrees. Second slot portion 1572 of slot 1570 extends in both directions from intersection 1580 at the terminus of first slot portion 1571. In the embodiment of FIG. 15, third slot portion 1573 extends not from and intersection with first slot portion 1571, but rather from intersection 1581 at one end of second slot portion 1572.

Figure 16:
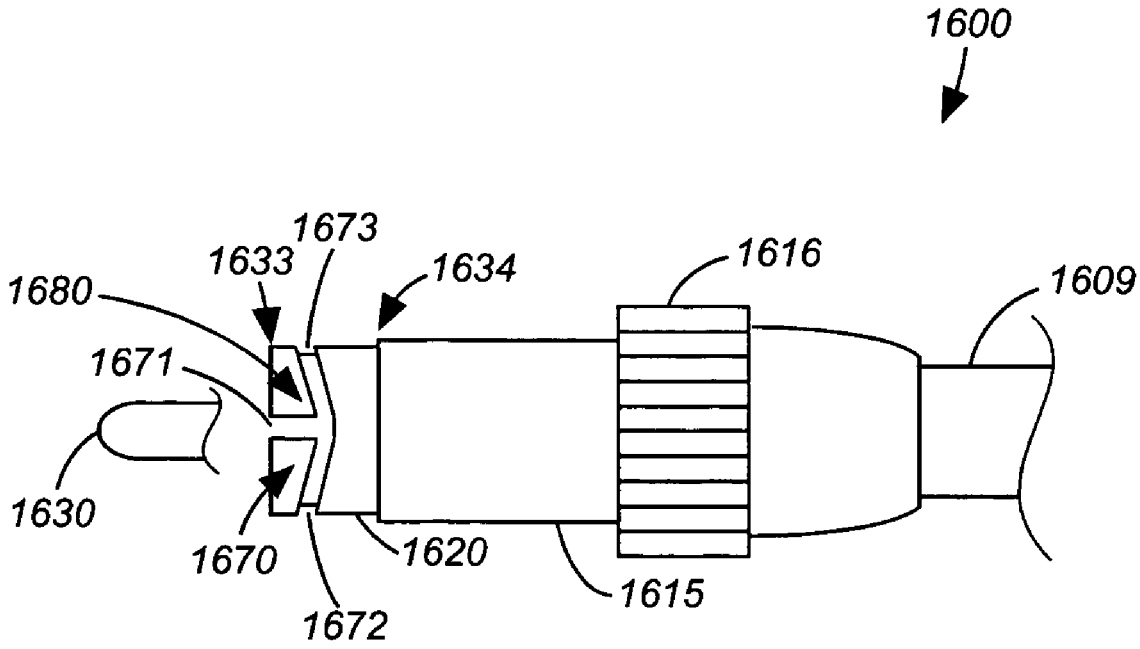
FIG. 16 is an illustration of a connector plug according to another embodiment of the present invention.

Another variation is illustrated in FIG. 16. FIG. 16 is an illustration of a connector plug 1600 according to another embodiment of the present invention. Connector plug 1600 is, in this embodiment, positioned at the terminus of cable 1609, and includes a body 1615 featuring a grip 1616. Probe 1630 and sleeve 1620 each facilitate both electrical and structural connections when the plug 1600 is engaged with a jack (not shown) or similar device. In the embodiment of FIG. 16, slot 1670 formed in sleeve 1620 includes a first slot portion 1671 extending from the distal end 1633 toward the proximate end 1634 of sleeve 1620 at an angle of approximately 90 degrees. Second slot portion 1672 of slot 1670 extends in one direction from intersection 1680 at the terminus of first slot portion 1671, and third slot portion 1673 extends in a different direction. In the embodiment of FIG. 15, both second slot portion 1672 and third slot portion 1673 extend a little more than one-quarter of the way around the perimeter of sleeve 1620, but are oriented to terminate somewhat closer to distal end 1633 than is intersection 1680.

Figure 17A:
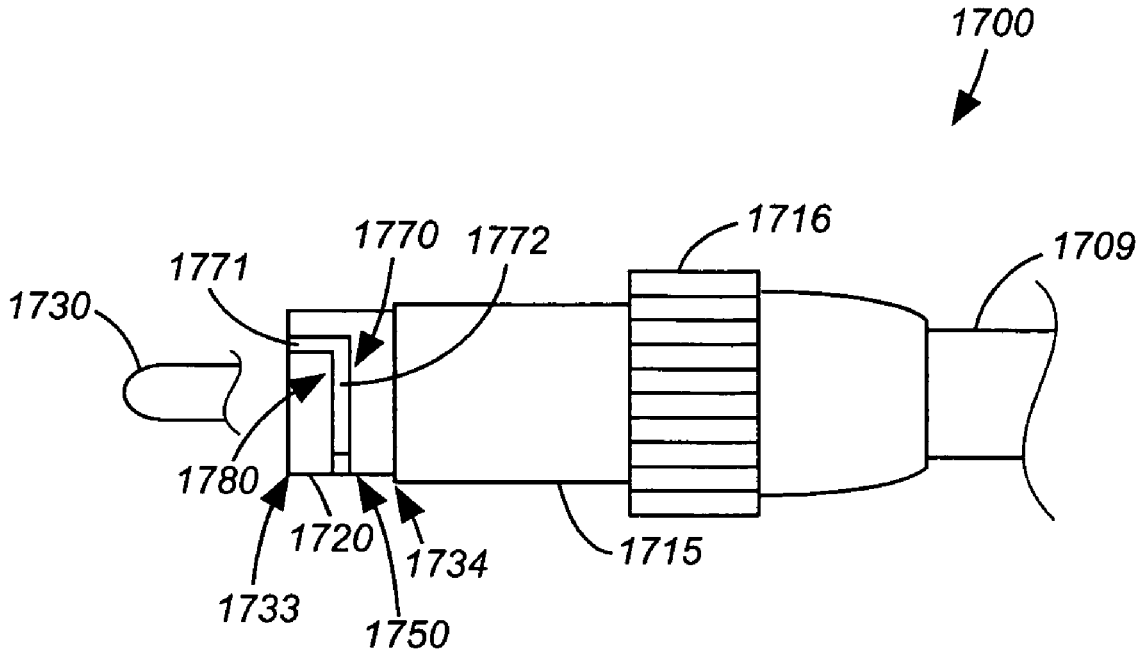
FIGS. 17*a* and 17*b* are, respectively, a side-view and a bottom-view illustration of a connector plug according to another embodiment of the present invention.
Figure 17B:
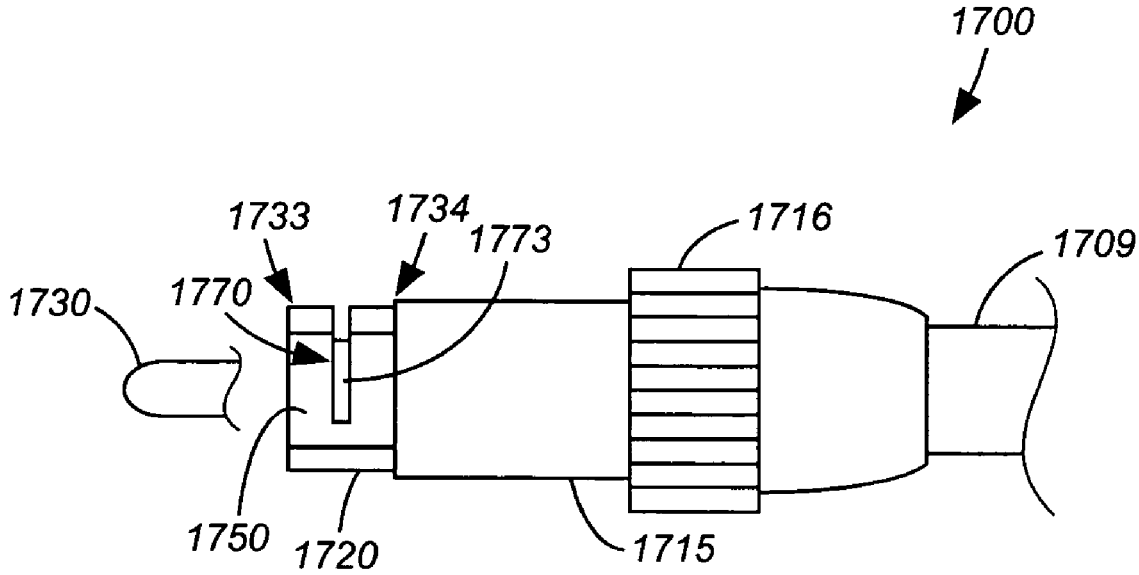
Figure 18:
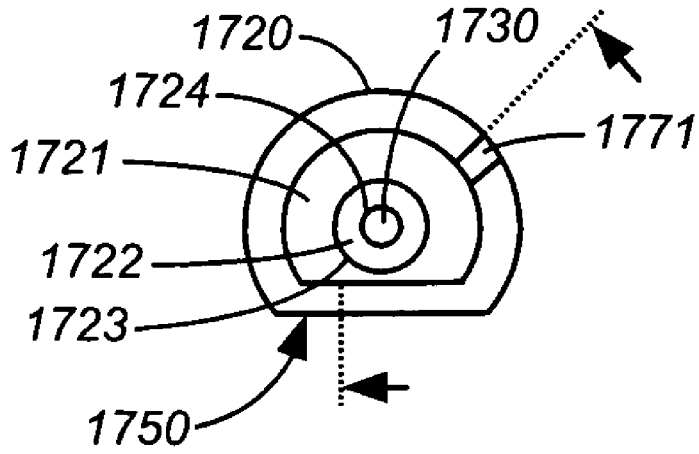
FIG. 18 is an end view of the sleeve and probe of connector of FIG. 17, viewed from its distal end.

Another variation is illustrated in FIGS. 17*a*, 17*b*, and 18. FIG. 17*a* is a side-view illustration of a connector plug 1700 according to another embodiment of the present invention. (Note that the denomination of this as a "side view" is arbitrary.) Connector plug 1700 is, in this embodiment, positioned at the terminus of cable 1709, and includes a body 1715 featuring a grip 1716. In the embodiment of FIG. 17, slot 1770 formed in sleeve 1720 includes a first slot portion 1771 extending from the distal end 1733 toward the proximate end 1734 of sleeve 1720 at an angle of approximately 90 degrees. Second slot portion 1772 of slot 1770 extends along the perimeter in one direction from intersection 1780 at the terminus of first slot portion 1771.

Unlike previous embodiments, however, the sleeve 1720 of connector 1700 is not entirely cylindrical in shape. Rather, sleeve 1720 forms a flat face 1750. Such a construction is not typical in A/V-type electrical connectors, but may have advantages in some applications. Providing an asymmetrical-shaped sleeve may by used, for example, to ensure that the plug and jack are engaged only when they are in a certain orientation with respect to each other. FIG. 17*b* is a bottom-view illustration of connector plug 1700. In this view, in which all of flat face 1750 is visible, it should be apparent that second slot portion 1772 of slot 1770 continues to extend along the flat portion of the sleeve's perimeter.

FIG. 18 is an end view of the sleeve 1720 and probe 1730 of connector 1700 of FIG. 17, viewed from its distal end 1733. In this view, probe 1730 may be seen disposed in opening 1724, opening 1724 being formed in insulating ring 1722 for this purpose. Insulating ring 1722, in turn, is disposed in an opening 1723 formed in the floor 1721 of sleeve 1720. First portion 1771 of slot 1770 is visible in this view. Second slot portion 1772 is not labeled in FIG. 18, but its extent in each direction from the intersection 1780 (see FIG. 17), is illustrated by the arrows and broken lines in FIG. 18. As with the other embodiments presented above, the lengths of extension (in either direction) may vary according to the preferences established for each particular application. The end of flat face 1750 of sleeve 1720 is shown in this illustration as well.

Note that these examples are for purpose of illustration, however, and not limitation; other variations are possible. Rather, descriptions above are of examples for implementing the invention, and the scope of the invention should not necessarily be limited by this description. Rather, the scope of the present invention is defined by the following claims.

What is claimed is:

1. An electrical connector for providing an electrical connection to an electrical cable having a pair of conductors, said electrical connector comprising:

a longitudinally-extending conductive probe electrically connected to a first lead of the electrical cable;

a conductive sleeve positioned about the longitudinally-extending conductive probe, said conductive sleeve spaced apart from and electrically isolated from the longitudinally-extending probe and electrically connected to a second lead of the electrical cable;

a slot member formed at said conductive sleeve and defining a channel extending radially all of the way through at least a distal portion thereof, said slot member commencing at a distal end portion of said conductor sleeve and including an angled part extending circumferentially in a plane perpendicular to a longitudinal direction defined by said longitudinally-extending conductive probe.

2. The electrical connector of claim 1, wherein said slot member commencing at a distal end portion of said conductor sleeve extends longitudinally along said conductor sleeve.

3. The electrical connector of claim 1, wherein said slot member commencing at a distal end portion of said conductor sleeve and said angled part intersect at an angle of approximately 90 degrees.

4. The electrical connector of claim 3, wherein the conductor sleeve defines a central axis, and wherein the slot member commencing at a distal end portion of said conductor sleeve extends inwardly from the distal end of the sleeve in an orientation parallel with the central axis.

5. The electrical connector of claim 1 wherein said slot member commencing at a distal end portion of said conductor sleeve extends in said longitudinal direction defined by said longitudinally-extending conductive probe.

6. The electrical connector of claim 1, wherein the distal end of the conductive sleeve member defines a plane, and wherein the orientation of said slot member commencing at a distal end portion of said conductor sleeve is orthogonal to the plane defined by the distal end.

7. The electrical connector of 1, wherein the sleeve is substantially cylindrical in shape.

8. The electrical connector of claim 1, wherein the sleeve is an electrical conductor.

* * * * *